US008251123B2

(12) United States Patent
Farris et al.

(10) Patent No.: US 8,251,123 B2
(45) Date of Patent: Aug. 28, 2012

(54) CASTING CORE ASSEMBLY METHODS

(75) Inventors: John R. Farris, Bolton, CT (US); Tracy A. Propheter-Hinckley, Manchester, CT (US); Douglas C. Jenne, West Hartford, CT (US); Matthew S. Gleiner, Vernon, CT (US); Peter H. Thomas, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 63 days.

(21) Appl. No.: 12/981,650

(22) Filed: Dec. 30, 2010

(65) Prior Publication Data

US 2012/0168108 A1 Jul. 5, 2012

(51) Int. Cl.
*B22C 9/04* (2006.01)
*B22C 9/10* (2006.01)

(52) U.S. Cl. ..... 164/28; 164/516; 164/35; 164/45; 164/369

(58) Field of Classification Search ..... 164/28, 164/35, 45, 516, 369
See application file for complete search history.

(56) References Cited

U.S. PATENT DOCUMENTS

| | | | |
|---|---|---|---|
| 5,394,932 | A | 3/1995 | Carozza et al. |
| 6,637,500 | B2 | 10/2003 | Shah et al. |
| 6,929,054 | B2 | 8/2005 | Beals et al. |
| 7,014,424 | B2 | 3/2006 | Cunha et al. |
| 7,134,475 | B2 | 11/2006 | Snyder et al. |
| 7,216,689 | B2 | 5/2007 | Verner et al. |
| 7,306,024 | B2 | 12/2007 | Beals et al. |
| 7,673,669 | B2 | 3/2010 | Snyder et al. |
| 2006/0239819 | A1 | 10/2006 | Albert et al. |
| 2010/0122789 | A1 | 5/2010 | Piggush et al. |

*Primary Examiner* — Kuang Lin
(74) *Attorney, Agent, or Firm* — Bachman & LaPointe, P.C.

(57) ABSTRACT

A casting core assembly includes a metallic core and a ceramic core. The process for forming the casting core assembly includes inserting a ceramic plug of a metallic core and ceramic plug core subassembly into a compartment of the ceramic core. The ceramic plug is secured to the ceramic core.

17 Claims, 5 Drawing Sheets

CASTING CORE ASSEMBLY METHODS

U.S. GOVERNMENT RIGHTS

The invention was made with U.S. Government support under contract N00019-02-C-3003 awarded by the U.S. Navy. The U.S. Government has certain rights in the invention.

BACKGROUND

The disclosure relates to investment casting. More particularly, it relates to the formation of investment casting of cores.

Investment casting is a commonly used technique for forming metallic components having complex geometries, especially hollow components, and is used in the fabrication of superalloy gas turbine engine components. The disclosure is described in respect to the production of particular superalloy castings, however it is understood that the disclosure is not so limited.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

The cooling passageway sections may be cast over casting cores. Ceramic casting cores may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned U.S. Pat. Nos. 6,637,500 of Shah et al., 6,929,054 of Beals et al., 7,014,424 of Cunha et al., 7,134,475 of Snyder et al., and U.S. Patent Publication No. 20060239819 of Albert et al. (the disclosures of which are incorporated by reference herein as if set forth at length) disclose use of ceramic and refractory metal core combinations.

SUMMARY

One aspect of the disclosure involves a process for forming a casting core assembly. The assembly includes a metallic core and a ceramic core. The process includes inserting a ceramic plug of a metallic core and ceramic plug core subassembly into a compartment of the ceramic core. The ceramic plug is secured to the ceramic core.

In various implementations, the securing may comprise introducing a ceramic adhesive between the plug and the compartment. The metallic core may be shaped and a coating may be applied to the shaped metallic core. The ceramic plug may be molded to the metallic core. The metallic core may be masked to mask wicking of ceramic during the molding. Such masking may comprise molding a sacrificial layer to the metallic core in a first die. The molding of the plug may comprise transferring the metallic core and sacrificial layer to a second die and introducing a ceramic-forming material to a plug-forming compartment of the second die. The molding of the sacrificial layer may comprise applying at least one pre-formed sacrificial member to the metallic core and cold molding the sacrificial layer from the pre-formed sacrificial member in the first die. The process may include heating to remove the sacrificial layer and harden the ceramic-forming material. The process may be a portion of a pattern-forming process which may be a portion of a shell-forming process and, in turn, which may be a portion of a casting process.

Another aspect involves casting core assembly comprising: a metallic core; a ceramic plug in which a portion of the metallic core is embedded; a ceramic core having a compartment in which the plug is received; and a ceramic adhesive joint between the plug and the ceramic core. The ceramic core may be an airfoil feedcore; and the metallic core may be an outlet core.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
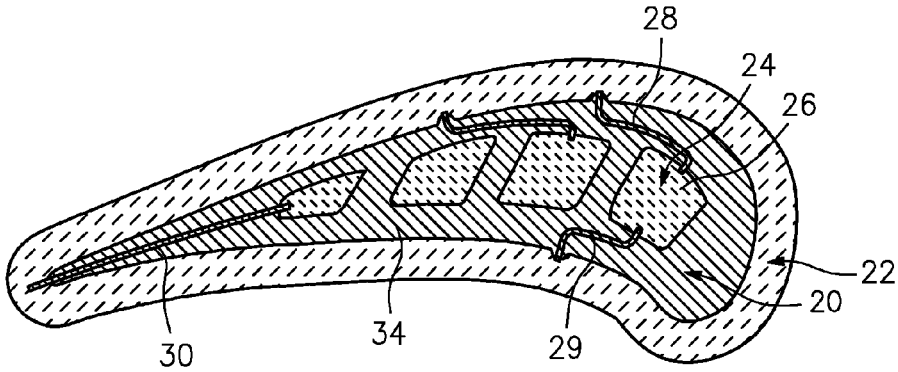
FIG. 1 is a streamwise sectional view of a gas turbine engine component casting in a casting shell.

FIG. 1 shows an exemplary casting 20 cast in a shell 22 over a casting core combination 24. The exemplary core combination 24 is formed as the assembly of one or more ceramic cores 26 and one or more metallic cores 28, 29, 30. In the exemplary core combination 24, the metallic casting cores are refractory metal cores (RMCs). Exemplary RMCs are refractory metal based (i.e., having substrates of at least fifty weight percent one or more refractory metals such as molybdenum, tungsten, niobium, or the like, optionally coated). The exemplary casting is of a turbine engine blade or vane having an airfoil portion 34. The exemplary casting is of a nickel-based superalloy or a cobalt-based superalloy.

In the exemplary configuration, the ceramic core 26 forms a multi-trunk feedcore (e.g., with a series of spanwise cooling passageway trunks in a streamwise array from near the leading edge to near the trailing edge). The RMCs then form outlet slots from trunks cast by the associated feedcore trunks. In the exemplary configuration, the RMCs 28 are generally to the suction side of the casting forming outlet passageways through the suction sidewall to the suction side surface; whereas the RMCs 29 are generally to the pressure side, forming outlet passageways to the pressure side surface; and the RMC 30 is along the trailing edge.

Figure 2:
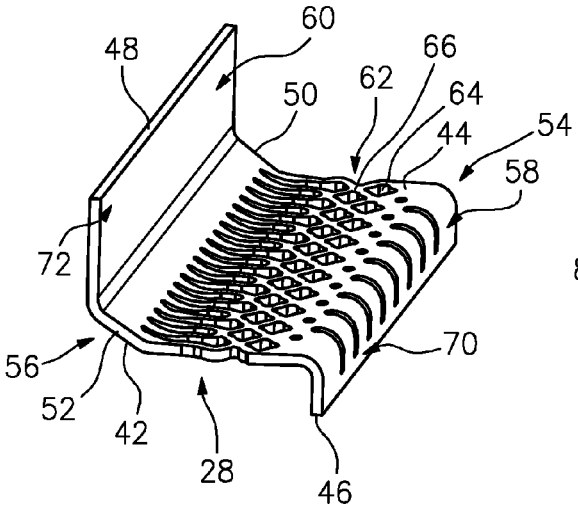
FIG. 2 is a view of a refractory metal core (RMC) used to form a core assembly within the shell.

Each refractory metal core may be formed by stamping and bending a refractory metal sheet to form a metallic substrate of the core and then coating the stamped/bent sheet with a full protective coating. An exemplary coating is an aluminide. The exemplary RMC 28 is intended to be illustrative of one possible general configuration. Other configurations, including simpler and more complex configurations are possible. The exemplary RMC (FIG. 2) has first and second principal side surfaces or faces 42 and 44 formed from faces of the original sheetstock. After the exemplary stamping/bending process, the RMC extends between first and second ends 46 and 48 and has first and second lateral edges 50 and 52 therebetween. First and second bent regions 54 and 56 divide first and second end sections 58 and 60 from a central body section 62. In the exemplary implementation, the end sections and central body sections are generally flat with the end sections at an approximate right angle to the body section.

The exemplary stamping process removes material to define a series of voids 64 separating a series of fine features 66. The fine features 66 will form internal passageways in the ultimate cast part. In the exemplary embodiment, the fine features 66 are formed as an interconnected web that may form a series of narrow parallel passageways through the wall of the cast airfoil. Intact distal portions 70 and 72 of the end sections 58 and 60 provide structural alignment.

In a conventional process of inserting the upstream (inlet end) distal portion 70 into a slot in an associated trunk of the feedcore, a bead of ceramic adhesive is introduced between the RMC and slot. There is a tendency of the adhesive to wick along the RMC. This wicking may cause irregular or otherwise undesired features in the ultimate casting. Removal of the wicked material (flash) may be difficult. To address this wicking, several alternatives involve pre-forming a ceramic plug along the portion of the RMC to be mated with the feedcore. Use of a plug may control the problems of flash in one or more ways. First, even if the application of the plug to the RMC produces flash, it may be easier to remove the flash than it is to remove flash from the securing of the RMC to the feedcore. For example, there may be easier physical access to regions of flash. Second, in various implementations, different techniques may be used for securing the plug to the RMC than would be used for securing the RMC directly to the feedcore. These techniques may limit flash. In addition to using different materials, it may be easier to control the orientation of the joint when a plug is being secured to the RMC. As is discussed below, this may include one or both of molding the plug to the RMC or securing the RMC to a pre-formed plug. Third, additional variations involve use of masks to prevent wicking/flash from occurring.

The basic techniques and steps for forming the RMCs and the feedcore may generally be the same as any baseline system being modified. In a cutting operation (e.g., laser cutting, electro-discharge machining (EDM), liquid jet machining, or stamping), one or more cuttings may be cut from a blank for forming the RMCs. The exemplary blank is of a refractory metal-based sheet stock (e.g., molybdenum or niobium) having a thickness in the vicinity of 0.01-0.10 inch (0.2-2.5 mm), more narrowly, 0.3-0.8 mm, between parallel first and second faces and transverse dimensions much greater than that (e.g., at least five times greater). Each exemplary cutting has the cut features of the associated RMC.

In a second step, if appropriate, each cutting is bent to form the associated bends as well as any other contouring (e.g., to more slightly bend a portion of the metallic core to more closely follow the associated pressure side or suction side of the airfoil). More complex forming procedures are also possible.

The RMC may be coated with a coating (e.g., to isolate the RMC from the molten casting alloy (to protect the alloy) and prevent oxidation of the refractory metal components). A variety of coatings are known. An exemplary coating is an aluminide (e.g., a platinum aluminide applied via chemical vapor deposition (CVD)). However, such an aluminide coating may offer poor resistance to wicking of plug material.

The feedcore may be pre-molded and, optionally, pre-fired. The exemplary molding involves molding a mixture of a ceramic powder and binder. The molding may compact the mixture to form a green compact. Thereafter, the core may be fired or otherwise heated to at least partially harden the core and remove the binder. Exemplary ceramic feedcore material is a fused silica with a paraffin binder injected to mold and then fired (e.g., at above 2000° F. (1093° C.)) to sinter/harden and burn off or volatize the paraffin. An alternative is a similar fused alumnia or a mixture of alumina and silica. Another alternative is a castable ceramic (e.g., silica and/or alumnina) in an aqueous or colloidal silica carrier which then dries to harden. Such material is often used as an adhesive or shell patch.

Figure 3:
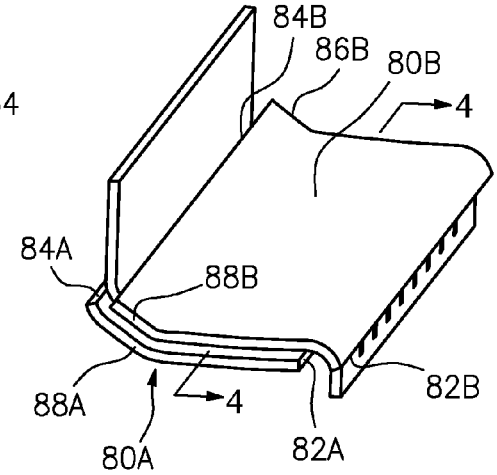
FIG. 3 is a view of the RMC during an initial masking stage.
Figure 4:
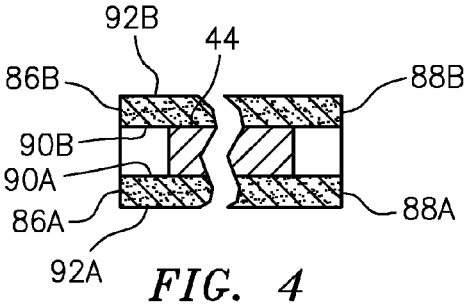
FIG. 4 is a cross-sectional view of the RMC of FIG. 3, taken along line 4-4.

In a first masking process for the RMC, a sacrificial masking material is applied to the RMC. The exemplary masking material is a natural or synthetic wax and is initially formed in sheets. In a first example (FIG. 3), the preformed sheets may be applied along both faces of the RMC along the central body section 62 and portions of the bends 54 and 56. The sheets may initially have essentially right angle edges or edges defined by whatever associated cutting process is used to cut the sheets from larger sheet material. Exemplary sheets 80A and 80B have associated leading edges (FIG. 4) 82A, 82B, trailing edges 84A, 84B, and lateral edges 86A, 86B and 88A, 88B. The sheets have exemplary first faces 90A, 90B and second faces 92A, 92B. The first faces respectively fall along the adjacent RMC face 42 or 44.

Figure 5:
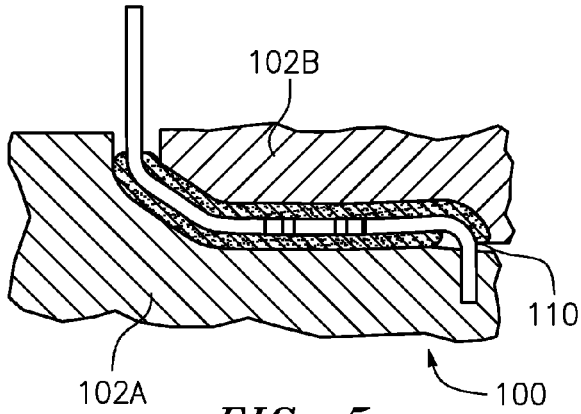
FIG. 5 is a sectional view of a cold molding fixture during a second stage of masking the RMC.
Figure 6:
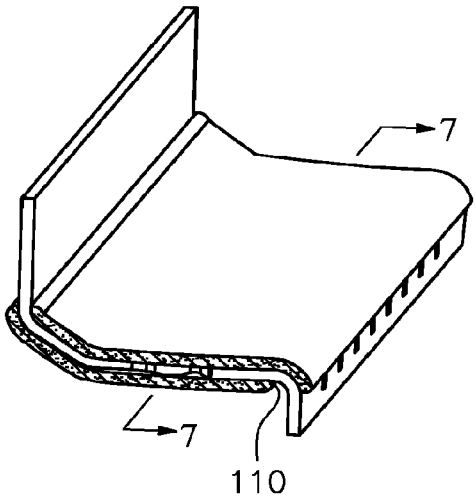
FIG. 6 is a view of the masked RMC.
Figure 7:
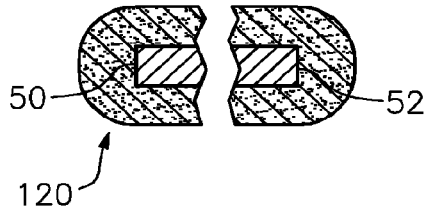
FIG. 7 is a sectional view of the masked RMC of FIG. 6, taken along line 7-7.
Figure 8:
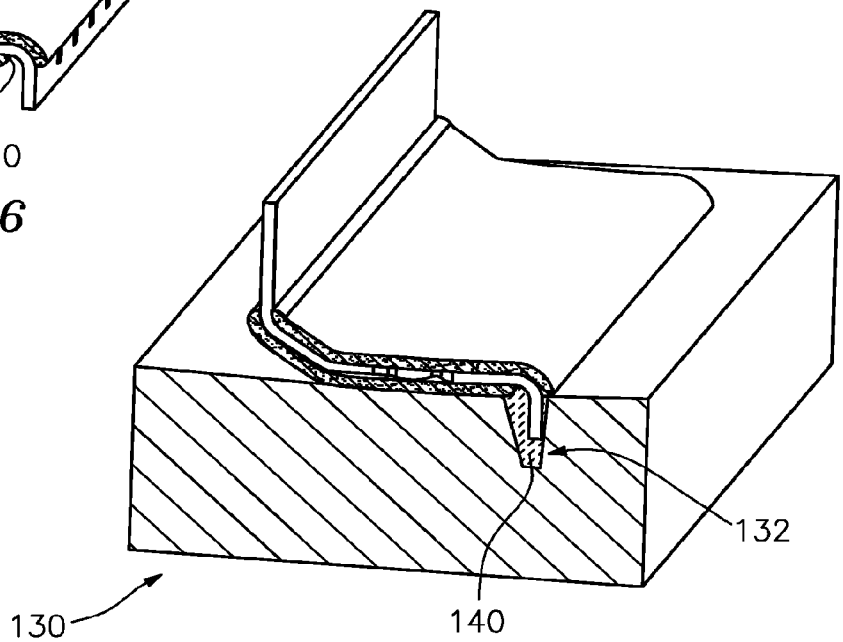
FIG. 8 is a view of the masked RMC in a plug-forming fixture during overmolding of a ceramic plug to the RMC.

The sheets may then be deformed in a cold wax die 100 (FIG. 5). For ease of illustration, FIG. 5 and subsequent figures omit any showing of wax which may have been pressed down into the RMC holes or around lateral portions of the RMC. The die has several pulls 102A, 102B. This forming process may more fully conform the sheets to the RMC and may redefine the sheet edges. For example, at the leading and trailing edges 82A, 82B, 84A, 84B, the material may tend to extrude/roll. Along the leading and trailing edges, this may create a central bulge 110 as the material extrudes between the die and RMC. Laterally, the two sheets may be pressed into engagement with each other to merge/join, overwrapping the lateral edges of the RMC (FIG. 7).

The RMC may be removed from the masking die along with the now-formed mask 120. To form the plug, the masked RMC may be transferred to a plug die 130 having a compartment 132 shaped for forming the plug. The leading edge portion of the RMC protrudes into the compartment.

The plug-forming material may then be introduced to the compartment. Exemplary plug-forming material is an aqueous colloidal slurry/slip which is essentially cast in its molding process. This exemplary plug casting/molding process may be performed at essentially room temperature. As noted above such material (e.g., silica and/or alumnina in an aqueous or colloidal silica carrier) is often used as an adhesive or shell patch. After the plug 140 has sufficiently dried/set, the masked/plugged RMC 150 (FIGS. 9 and 10) is then removed from the plug-forming die. The waxed/plugged RMC may then be secured to the feedcore, with the plug received in the compartment/slot 160 (FIG. 11) of the feedcore. An exemplary securing comprises introducing a ceramic adhesive 170 between the plug and the slot. The ceramic adhesive 170 may also be such a slurry/slip.

Figure 10:
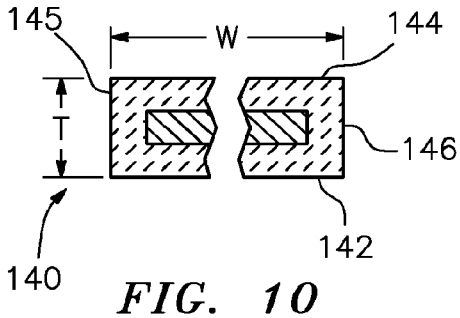
FIG. 10 is a cross-sectional view of the masked/plugged RMC, taken along line 10-10.
Figure 9:
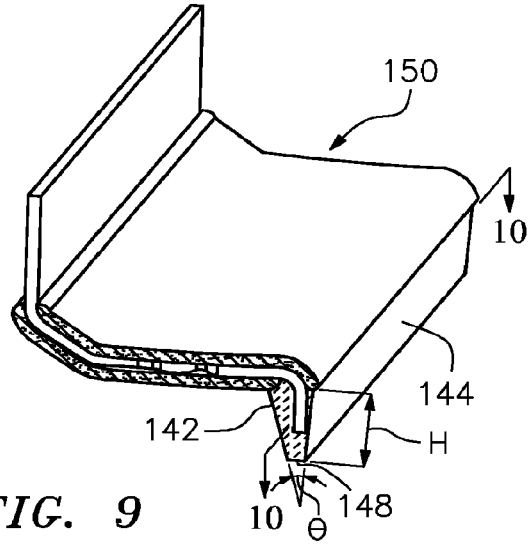
FIG. 9 is a view of the masked/plugged RMC.
Figure 11:
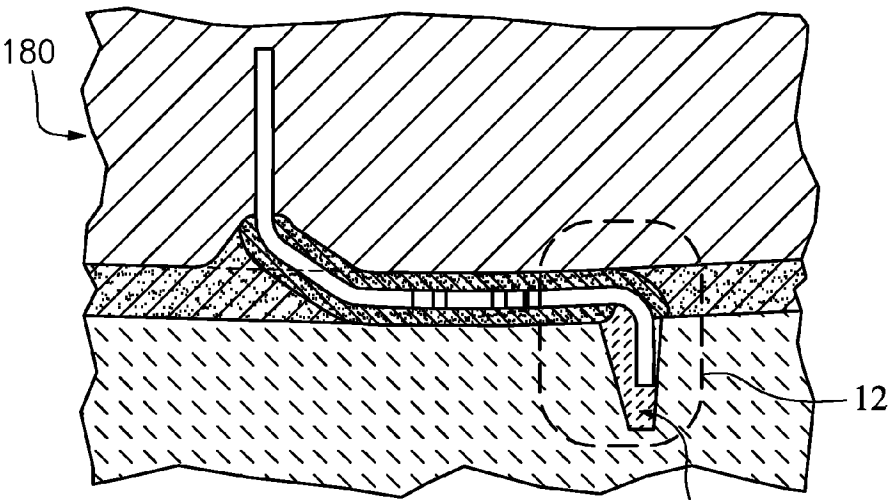
FIG. 11 is a sectional view of the masked/plugged RMC mated to a feedcore and engaged to a pattern-forming die.
Figure 12:
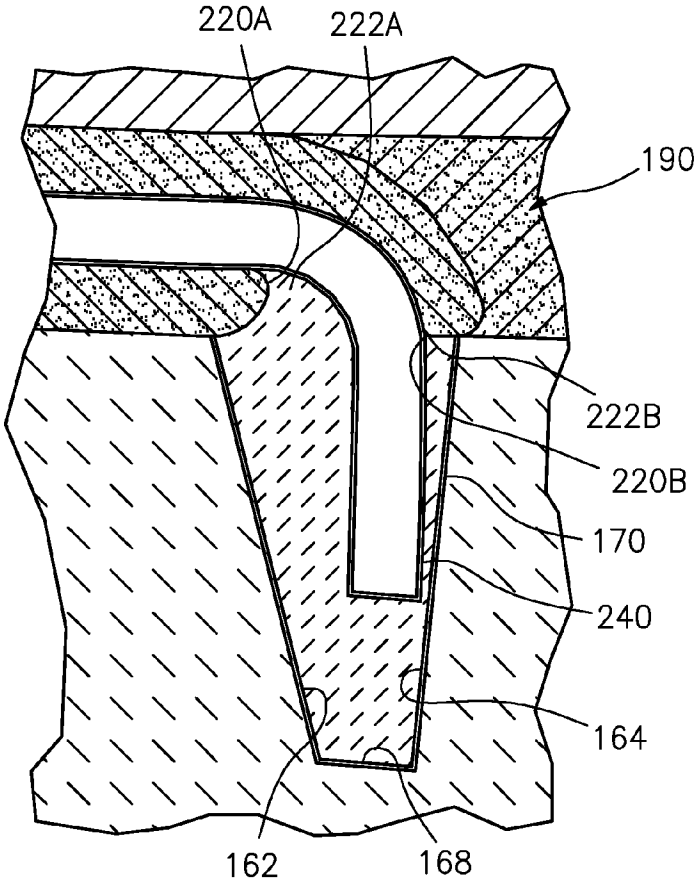
FIG. 12 is an enlarged view of a leading region of the masked/plugged RMC of FIG. 11.

FIGS. 9 and 10 show the exemplary plug having faces 142 and 144 generally aligned with the faces 42 and 44 along the portion 70. These, however, may be provided with a slight taper toward an end face/facet 148. An exemplary taper angle θ is less than 30° or less than 20° (e.g., 5-10° (e.g., about 6° with about 3° between each face of the plug and the adjacent face of the RMC)). FIG. 10 also shows lateral edges 144 and 146 of the plug with a width W therebetween. A thickness between the faces 142 and 144 is shown as T. A height of the plug is shown as H. FIGS. 11 and 12 similarly show the compartment 160 as having faces complementary to and dimensioned for receiving the plug. FIG. 12 shows faces 162 and 164 respectively in close facing proximity to the faces 142 and 144 forming slot sidewalls and a face 168 forming a slot bottom in close facing relationship to the face 148. Dimensions of the slot may differ from dimensions of the plug by the anticipated thickness of the adhesive used. Exemplary T is 1.0-5.0 mm at the thickest portion of the plug, more particularly, 1.5-3.0 mm or about 1.8 mm. Exemplary such T may be 2-10 times the thickness of the RMC, more narrowly, 3-5. Exemplary T is 0.75-4.0 mm at the narrowest portion of the plug (e.g., the facet 148), more particularly, 1.0-2.0 mm. Exemplary T at the narrowest portion of the plug may be slightly greater than the RMC thickness (e.g., 0-0.5 mm greater or, more narrowly 0.05-0.1 mm or 0.06-0.07 mm). Exemplary spacing of the face/facet 148 away from the adjacent edge of the RMC is 0-1 mm, more narrowly 0.3-0.5 mm or 0.35-0.40 mm. Exemplary W is at least 20 mm, more narrowly, 20-200 mm. Exemplary H is 2-10 mm, more narrowly, 3-6 mm.

When the joint between the plug and the feedcore has sufficiently hardened (dried/cured) the resulting core assembly may then be transferred to a pattern-forming die 180. The pattern-forming die defines a compartment containing the core assembly into which a pattern-forming material 190 is injected. The exemplary pattern-forming material may similarly be a natural or synthetic wax.

Figure 13:
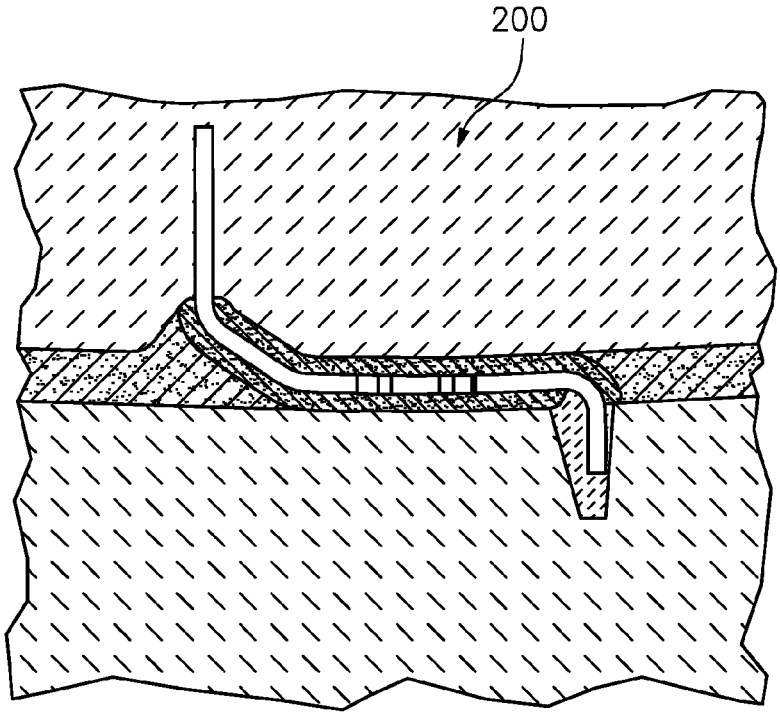
FIG. 13 is a sectional view of a shelled pattern including the masked/plugged RMC.
Figure 14:
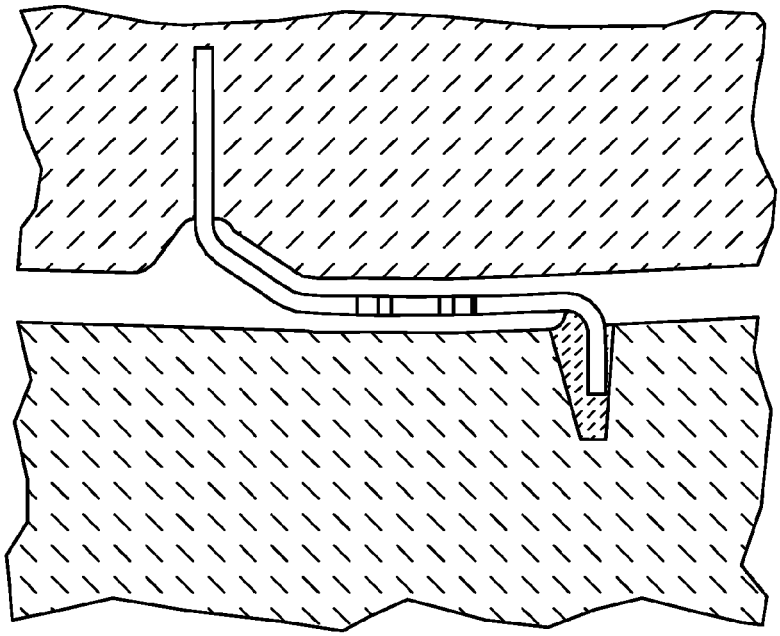
FIG. 14 is a sectional view of a shell of FIG. 13 after removal of the mask and pattern material.

The overmolded core assembly (or group of assemblies) forms a casting pattern with an exterior shape largely corresponding to the exterior shape of the part to be cast. The pattern may then be assembled to a shelling fixture (not shown, e.g., via wax welding between end plates of the fixture). The pattern may then be shelled (e.g., via one or more stages of slurry dipping, slurry spraying, or the like). After the shell 200 (FIG. 13) is built up, it may be dried. The drying provides the shell with at least sufficient strength or other physical integrity properties to permit subsequent processing. For example, the shell containing the invested core assembly may be disassembled fully or partially from the shelling fixture and then transferred to a dewaxer (e.g., a steam autoclave). In the dewaxer, a steam dewax process removes a major portion of the wax leaving the core assembly secured within the shell (FIG. 14). The shell and core assembly will largely form the ultimate mold. However, the dewax process typically leaves a residue on the shell interior and core assembly.

After the dewax, the shell may be transferred to a furnace (e.g., containing air or other oxidizing atmosphere) in which it is heated to strengthen the shell and remove any remaining wax residue (e.g., by vaporization) and/or converting hydrocarbon residue to carbon. Oxygen in the atmosphere reacts with the carbon to form carbon dioxide. Removal of the carbon is advantageous to reduce or eliminate the formation of detrimental carbides in the metal casting. Removing carbon offers the additional advantage of reducing the potential for clogging the vacuum pumps used in subsequent stages of operation.

The mold may be removed from the atmospheric furnace, allowed to cool, and inspected. The mold may be seeded by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures. The mold may be transferred to a casting furnace (e.g., placed atop a chill plate (not shown) in the furnace). The casting furnace may be pumped down to vacuum or charged with a non-oxidizing atmosphere (e.g., inert gas) to prevent oxidation of the casting alloy. The casting furnace is heated to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy may be poured into the mold and the mold is allowed to cool to solidify the alloy (e.g., after withdrawal from the furnace hot zone). After solidification, the vacuum may be broken and the chilled mold removed from the casting furnace. The shell may be removed in a deshelling process (e.g., mechanical breaking of the shell).

The core assembly is removed in a decoring process such as alkaline and/or acid leaching (e.g., to leave a cast article (e.g., a metallic precursor of the ultimate part)). The cast article may be machined, chemically and/or thermally treated and coated to form the ultimate part. Some or all of any machining or chemical or thermal treatment may be performed before the decoring.

Figure 15:
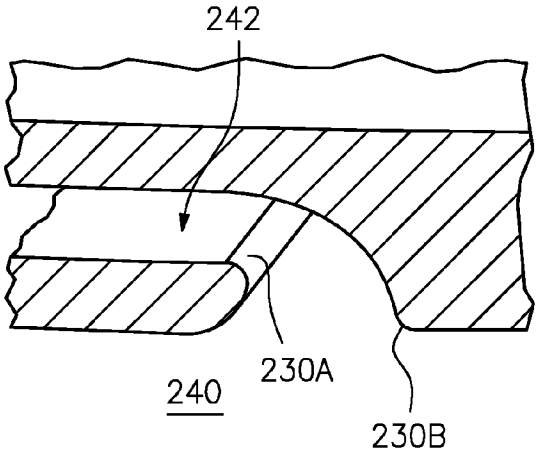
FIG. 15 is a sectional view of an inlet region of an outlet passageway cast by the RMC.

As is noted above, the molding of the mask to the RMC may create the bulges 110 (FIG. 5) which form negative lead-ins 220A, 220B (FIG. 12) from the wax to the RMC. For example, FIG. 12 shows the wax material protruding away from the location of initial contact with the RMC with a convexly rounded cross-section at junctions of the inboard face (adjacent the RMC) of the wax layer. Similarly, a junction of the outboard face of the wax layer with the leading edge of such layer may have a convex cross-section. During the plug molding process, the plug material will fill the gap provided by the negative lead-in and thereby provide a positive lead-in 222A, 222B of the plug relative to the RMC. This provides a concave outward cross-section. When the ultimate part is cast, the positive lead-in of the plug provides a corresponding lead-in 230A, 230B (FIG. 15) from the feed passageway 240 to the outlet passageway 242 so as to provide a more gradual transition than would be achieved by a more abrupt RMC-to-feedcore junction. FIG. 12 also shows the protective coating layer (e.g., aluminide) atop the RMC.

A first alternate process may be otherwise similar to the process described above. This process, however, forms the plug via materials and techniques more traditionally used to form ceramic cores such as the feedcore. The masked RMC may be formed by the process described above. The cold plug-forming die may be inappropriate for the modified technique (e.g., a different die technology may be used). After molding of the plug in a green state, the masked/plugged RMC is baked to harden the plug. This baking melts the wax.

Figure 17:
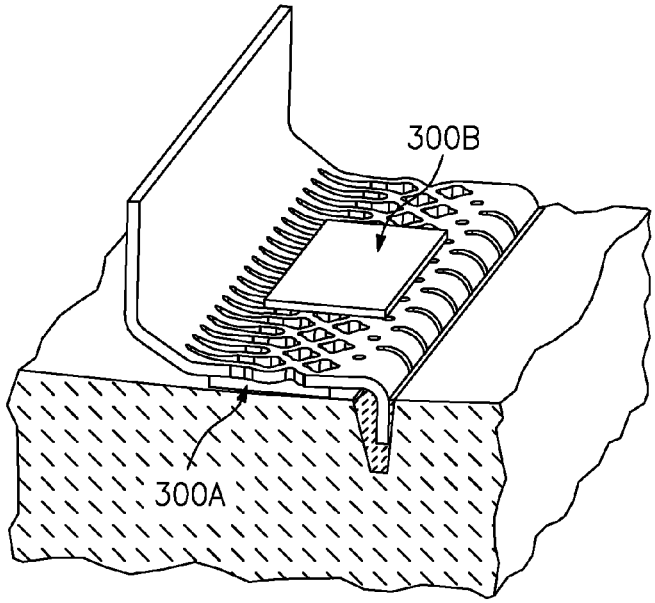
FIG. 17 is a view of the masked/plugged RMC of FIG. 16 with wax positioning pads applied.
Figure 16:
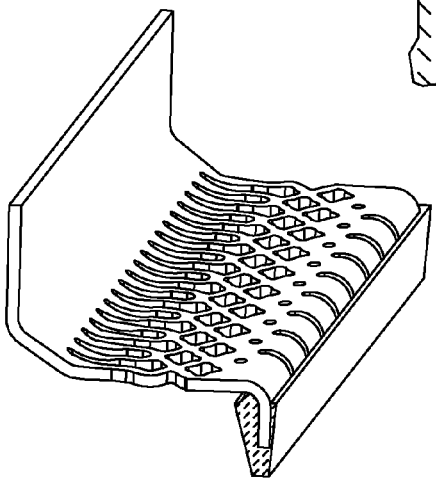
FIG. 16 is a view of a partially cutaway second plugged RMC.
Figure 18:
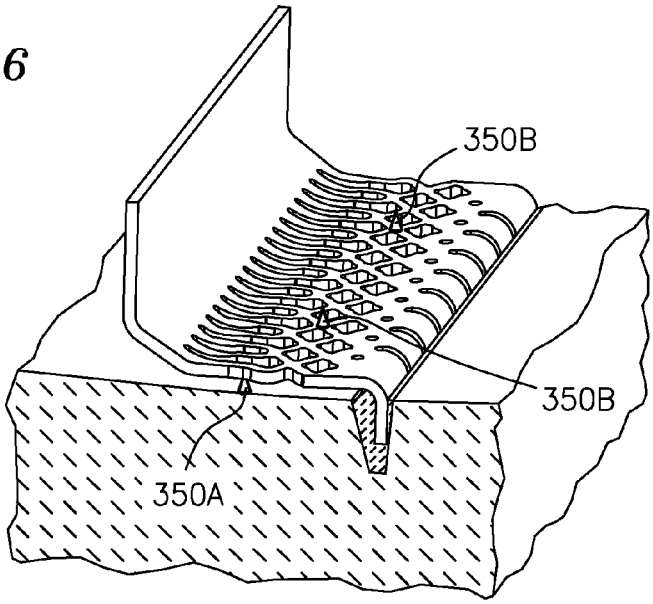
FIG. 18 is a partially cutaway view of the plugged RMC of FIG. 16 with positioning chaplets applied and mated to a ceramic feedcore.

As a positioning feature, one or more wax sheets 300A, 300B (FIG. 17) or segments thereof may be placed along the faces of the RMC. Although there may be a cold molding process, this has less relevance than in the initial masking situation. The plugged core and positioning wax may be assembled and secured to the feedcore as described above. Thereafter, placement in the pattern-forming die and subsequent steps may be similarly performed to those described above. Yet a further variation replaces the wax sheet in the core positioning stage with conventional chaplets 350A, 350B on either side of the RMC.

Yet a further variation involves using a similar conventional core ceramic to form the plug as discussed above.

However, rather than baking, the masked/plugged RMC (with a green plug) may be mated to the feedcore with the feedcore also in a green state. The assembly may then be baked. The baking may join/fuse the plug and feedcore. During baking, the plug may be held in the socket of the feedcore with sufficient pressure to assist fusing. Alternatively or additionally, a ceramic slip or slurry may be added at the interface/junction. The baking may melt away the masking material. The chaplets 350A and 350B (or other shim) may then be applied. This may involve sliding or rolling the chaplets 350A between the RMC and feedcore. Thereafter, placement in the pattern-forming die and subsequent process steps may be otherwise similar to those described above.

One or more embodiments have been described. Nevertheless, it will be understood that various modifications may be made. For example, details of the particular components being manufactured will influence or dictate details (e.g., shapes, particular materials, particular processing parameters) of any particular implementation. Thus, other core combinations may be used. Accordingly, other embodiments are within the scope of the following claims.

What is claimed is:

1. A process for forming a casting core assembly, the assembly comprising a metallic core and a ceramic core, the process comprising:
- inserting a ceramic plug of the metallic core into a compartment in the ceramic core; and
- securing the ceramic plug to the ceramic core.

2. The process of claim 1 wherein:
- the securing comprises introducing a ceramic adhesive between the plug and compartment.

3. The process of claim 1 further comprising:
- shaping the metallic core; and
- applying an aluminide coating to the shaped metallic core.

4. The process of claim 1 further comprising:
- molding the ceramic plug to the metallic core.

5. The process of claim 4 further comprising:
- masking the metallic core to mask wicking of ceramic during the molding.

6. The process of claim 4 further comprising:
- molding the ceramic core at a higher temperature than the molding of the ceramic plug.

7. The process of claim 4 wherein further comprising:
- molding a sacrificial layer to the metallic core in a first die, and wherein the molding of the plug comprises:
- transferring the metallic core and sacrificial layer to a second die; and
- introducing a ceramic-forming material to a plug-forming compartment of the second die.

8. The process of claim 7 wherein the molding of the sacrificial layer comprises:
- applying at least one pre-formed sacrificial member to the metallic core; and
- cold molding the sacrificial layer from the pre-formed sacrificial member in the first die.

9. The process of claim 7 wherein the molding of the sacrificial layer comprises:
- applying a first wax sheet to a first face of the metallic core;
- applying a second wax sheet to a second face of the metallic core; and
- cold molding the sacrificial layer from the wax sheets in the first die.

10. The process of claim 7 further comprising:
- heating to remove the sacrificial layer and harden the ceramic-forming material.

11. The process of claim 7 being a portion of a pattern-forming process and further comprising:
- removing the sacrificial layer; and
- hardening the ceramic-forming material, the pattern-forming process further comprising:
- applying a further sacrificial member to the metallic core;
- overmolding a main pattern-forming material to the core assembly in a pattern-forming die, the further sacrificial member maintaining a position of the metallic core in the pattern-forming die.

12. The process of claim 11 being a portion of a shell-forming process, the shell-forming process further comprising:
- shelling the pattern; and
- removing the further sacrificial material and main pattern-forming material and hardening the shell.

13. The process of claim 12 being a portion of a casting process, the casting process further comprising:
- introducing molten metal to the shell;
- allowing the metal to solidify;
- destructively removing the shell and the core assembly.

14. The process of claim 1 wherein:
- the ceramic core forms a feed passageway in an airfoil; and
- the metallic core forms an outlet passageway from the feed passageway to a pressure side or a suction side of the airfoil.

15. The process of claim 1 further comprising:
- placing first and second wax sheets on respective first and second sides of the metallic casting core;
- cold forming the sheets while on the metallic casting core in a cold wax die to form a contour;
- placing the metallic casting core and formed first and second sheets into a plug die; and
- introducing a ceramic-forming material to the plug die to form the ceramic plug.

16. A casting core assembly comprising:
- a metallic core;
- a ceramic plug in which a portion of the metallic core is embedded;
- a ceramic core having a compartment in which the plug is received; and
- a ceramic adhesive joint between the plug and the ceramic core.

17. The assembly of claim 16 wherein:
- the ceramic core is an airfoil feedcore; and
- the metallic core is an outlet core.

* * * * *